United States Patent [19]

Matthison-Hansen

[11] Patent Number: 4,506,479

[45] Date of Patent: Mar. 26, 1985

[54] ROOF OR WALL COVERING AND MOUNTING MEMBER FOR A GUTTER BRACKET

[76] Inventor: John E. Matthison-Hansen, No. 16 Lille Lyngbyvej, DK-3320 Skevinge, Denmark

[21] Appl. No.: 463,871

[22] PCT Filed: May 26, 1982

[86] PCT No.: PCT/DK82/00050

§ 371 Date: Jan. 25, 1983

§ 102(e) Date: Jan. 25, 1983

[87] PCT Pub. No.: WO82/04457

PCT Pub. Date: Dec. 23, 1982

[30] Foreign Application Priority Data

Jun. 11, 1981 [DK] Denmark ..... 2547/81

[51] Int. Cl.[3] ..... E04D 13/00

[52] U.S. Cl. ..... 52/15; 52/94; 52/466

[58] Field of Search ..... 52/11–15, 52/94, 459–472

[56] References Cited

U.S. PATENT DOCUMENTS 141,929 8/1873 Hegeler et al. ..... 52/11
183,519 10/1876 Vaile ..... 52/11
1,780,862 11/1930 Bloss ..... 52/466
2,234,799 3/1941 Eason ..... 52/466

FOREIGN PATENT DOCUMENTS 893857 9/1954 Fed. Rep. of Germany ..... 52/94

*Primary Examiner*—James L. Ridgill, Jr.
*Attorney, Agent, or Firm*—Stevens, Davis, Miller & Mosher

[57] ABSTRACT

The covering is composed of alternate broader lower strips (1) and narrower upper strips (2), the outer surfaces of which strips are concave and convex, respectively. The strips are resiliently connected to one another and to fastening brackets (3) by means of interengaging longitudinal edge zones (6, 11, 14) on the strips and the brackets. The profile of each edge zone (6) of the lower strips (1) is S-shaped and includes a convex portion (7) engaging with a concave surface on an edge zone (14) of the bracket, and a portion (8, 9, 8', 10) which embraces the edge zone of the bracket. Each edge zone (11) of the upper strips (2) embraces the outermost portion (9, 8', 10) of an edge zone of a lower strip. A gutter (20) bracket (21) can be clamped between an upper strip (2) and the adjoining lower strips (1) by means of a mounting member (22) comprising a main part (23, 24) which, together with the gutter bracket, is urged downwardly into the edge zones of the lower strips by means of a threaded bolt (28), and a clamp (26) which is urged upwardly against the upper strip (2).

5 Claims, 6 Drawing Figures

ROOF OR WALL COVERING AND MOUNTING MEMBER FOR A GUTTER BRACKET

BACKGROUND OF THE INVENTION

The present invention relates to a roof or wall covering made of sheet material and comprising alternate wider and narrower strips, the outwardly oriented surfaces of which are concave and convex, respectively, and which have interengaging, folded longitudinal edge zones, and fastening members for securing the covering to a supporting substructure.

From Danish Patent Specification No. 134 789 there is known a roof covering of this kind in which the cross sectional profile of the edge zones of the concave strips is U-shaped while the profile of the convex strips is C-shaped. For assembling the covering each convex strip is slid longitudinally into engagement with two adjoining concave strips, with each of its edge zones located between the limbs of the U-shaped edge zone of a concave strip. The convex strips serve for creating a watertight connection between the concave strips which, according to the patent specification, are secured to a supporting substructure in a conventional manner not described in any detail.

SUMMARY OF THE INVENTION

According to the present invention a roof or wall covering of the kind referred to above is characterized in that the cross sectional profile of the longitudinal edge zones of the concave strips is S-shaped and comprises an inner portion adjoining the central section of the strip and curved towards the concave face of said central section, said inner portion having a first radius of curvature, a median portion curved in the opposite direction and having a second, smaller radius of curvature, and an outer portion having a third radius of curvature larger than the first radius of curvature;

that the fastening members are generally U-shaped brackets, each having a web portion secured to the substructure and two lateral flanges, the free edge zones of which are profiled complementary to the edge zones of the concave strips and are retracted inwardly towards the centre line of the U at the transition to the adjoining portion of the respective lateral flange;

that the edge zones of the convex strips are profiled complementary to the median and outer portions of the edge zones of the concave strips;

and that the width of the convex strips is smaller than the total outer width of a fastening bracket plus the edge zones of two concave strips inserted in the bracket fom opposite sides thereof.

The invention results in several advantages, including a highly efficient securing of the strips to the substructure due to the fact that the convex strips embrace a substantial portion of the fastening brackets and the edge zones of the intermediate concave strips and hold the latter securely by means of elastic forces determined by their being deformed from the unloaded state to the mounted or assembled position. Forces acting on the concave strips from the outside of the covering and directed towards the substructure will tend to deform the convex strips further whereby the reaction forces exerted by these strips increase. Suction forces acting on the outer side of the covering are taken up by the brackets as a result of the interengagement between the edge zones of the brackets and the S-shaped edge zones of the concave strips. Assembling the strips is an extremely simple operation, one edge zone of each concave strip being pushed sideways into the lateral flanges on the associated row of brackets, following which the strip is compressed laterally until its other edge zone can be moved past the associated row of brackets and snap into the lateral flanges of those brackets accompanied by a certain relaxation of the strip. The spacing between the two rows of brackets is chosen somewhat less than the spacing corresponding to the width of the strip in its unloaded or fully relaxed state, but the resiliency of the strips permits some variation of the spacing chosen. After the two concave strips engaging in one and the same row of brackets have been inserted, the associated convex strip is mounted simply by being pushed downwards over the edge zones of the concave strips whereby said edge zones are pulled into intimate contact with the brackets. The brackets can be fastened to the substructure in advance, e.g. by means of nails, spikes or screws, if desired before the substructure is mounted on the building which, in the case of a roof covering, reduces the number of operations to be performed on the roof. In this connection it is also advantageous that the mounting of the strips in the pre-fastened brackets does not require any tools. The intimate contact between the concave and the convex strips along a considerable contact area precludes the penetration of rain, snow etc. into the joints. The downwardly oriented edges of the convex strips also act as drips, and consequently the covering can be used for roofs of low rise or slope and on rather uneven substructures, without requiring separate sealing elements in the joints between the strips. The resiliency of the strips and of the joints between the strips and the brackets can compensate for possible later dislocations of the substructure. Since none of the strips is fastened directly to the substructure an efficient ventilation of the entire space between the substructure and the strips is obtainable.

The edge zone profile of the concave strips may comprise two parallel, rectilinear or substantially rectilinear transition portions connecting the inner portion of the profile with the median portion thereof and the median portion of the profile with the outer, curved portion thereof, respectively. With given radii of curvature of the curved portions of the profile this feature results in a larger area of the surfaces in which there is engagement between the concave and convex strips and between the concave strips and the brackets.

The invention also relates to a member for mounting a gutter bracket or a similar element, e.g. for mounting a snow fence, associated with a roof covering according to the main invention. The mounting member is characterized in that it consists of a bracket of sheet material having two edge zones, the profile of which is the same as that of the outer part of the edge zones of the fastening members, and a median part with a through-hole for a clamping bolt, and of a clamp resiliently connected to said median part and having an upwardly oriented curvature corresponding to the curvature of the median part of the convex roof strips. The configuration of the three components of the covering, which characterizes the main invention, is a prerequisite for the claimed mounting member, a major advantage of which is that the gutter brackets can be mounted after the roof covering has been installed and that each bracket can be held securely between an associated convex strip and the two concave strips engaging therewith. Each gutter bracket is inserted between the bracket of sheet material and the clamp, and it is fixed by means of the clamping bolt which, from below, is screwed through a threaded hole in the gutter bracket whereby it urges the clamp upwardly against the convex strip while simultaneously the sheet material bracket is urged, via the gutter bracket, downwardly into the edge zones of the concave strips. The installation of the gutter brackets after the roof covering has been laid permits a simplification of the mounting of the gutter which now can take place immediately after the installation of the gutter brackets, and an exact location of the gutter relative to the lower edge of the roofing can be ensured by properly locating each mounting member.

BRIEF DESCRIPTION OF THE DRAWINGS

The invention will now be described in more detail with reference to the accompanying drawings which schematically show an example of a roof covering according to the invention. In the drawings

DETAILED DESCRIPTION

Figure 1:
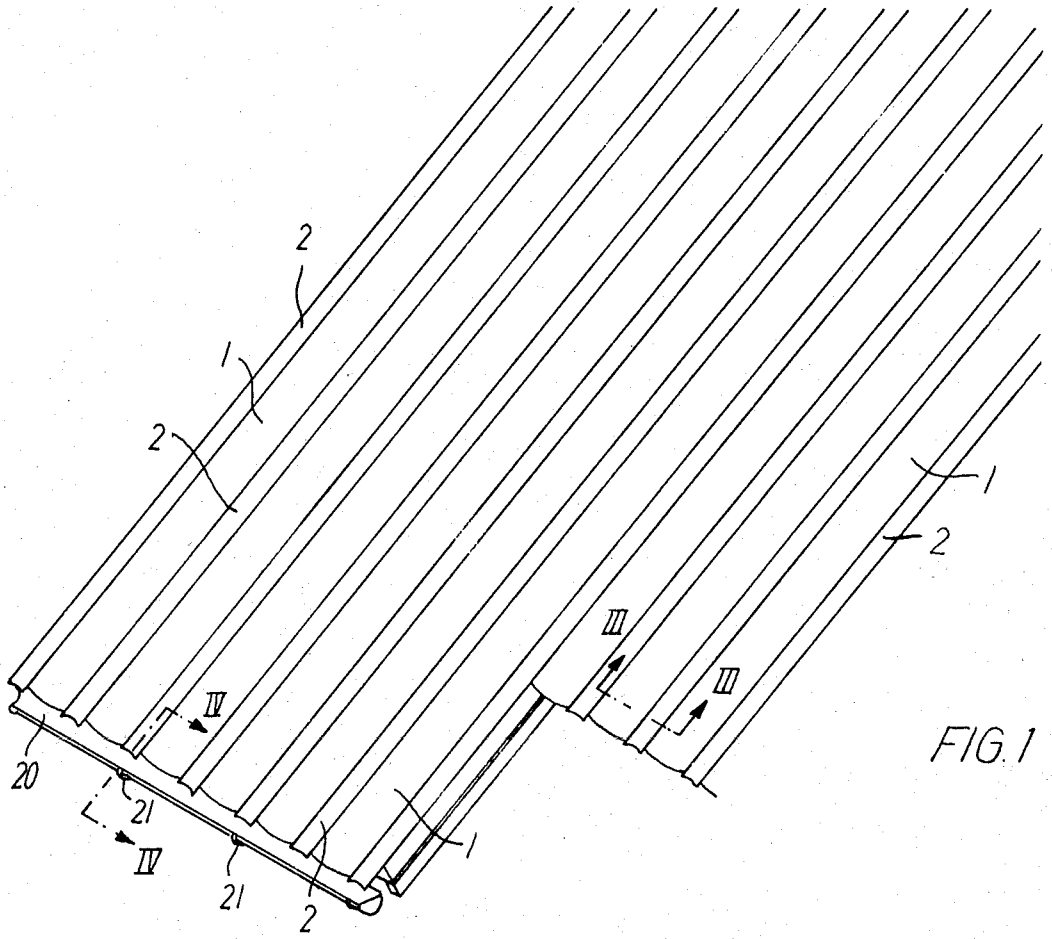
FIG. 1 is an isometric fractional view of the roof covering including part of a gutter associated therewith.
Figure 2:
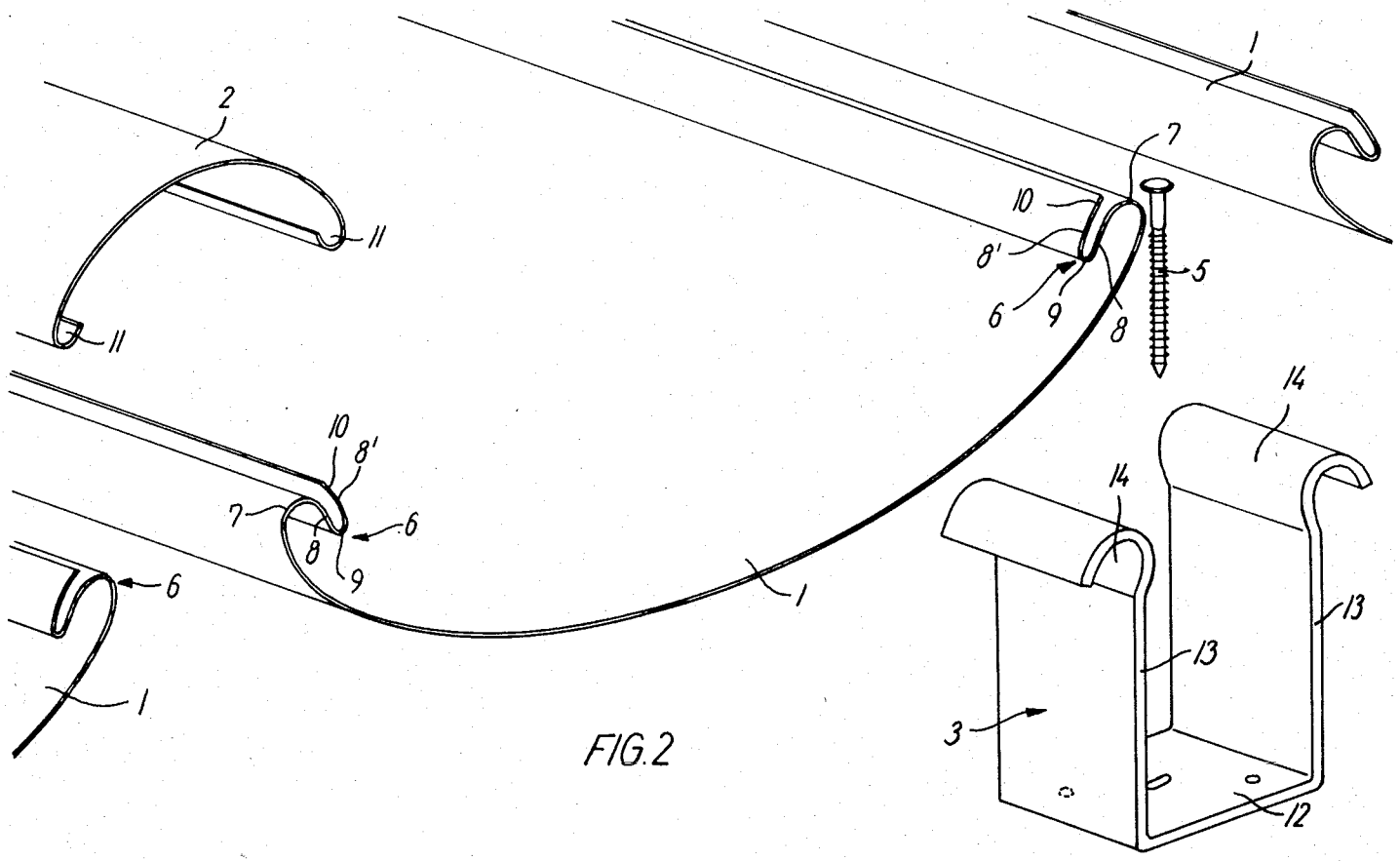
FIG. 2 is an exploded view, on a larger scale, of the three components of which the roof covering is composed.

The roof covering illustrated in the drawings is composed of alternate lower strips 1 and upper strips 2 which are connected together and secured to the substructure of the roof by means of brackets 3. Strips 1 and 2, which are made of a relatively thin and resilient sheet material, preferably metal, have upwardly facing surfaces which are concave and convex, respectively. As shown strips 1 are substantially wider than strips 2. In most cases it is possible to make the strips long enough to extend from the ridge of the roof to the gutter without overlapping.

Figure 3:
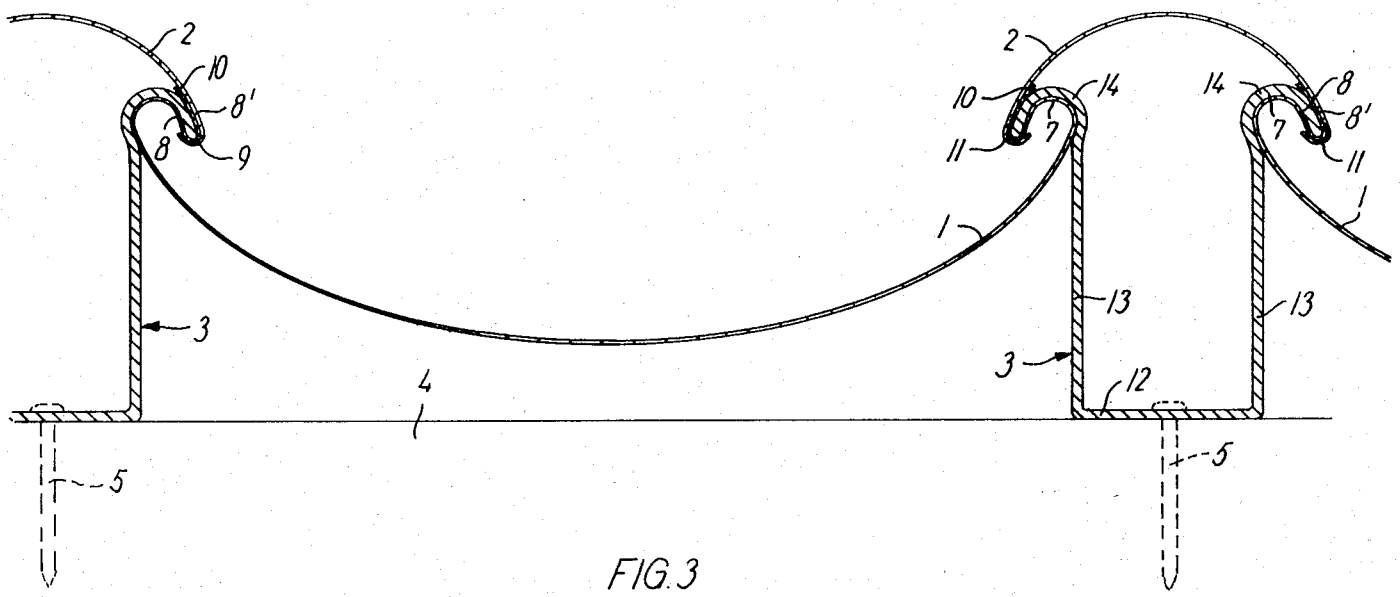
FIG. 3 is a cross section, on a corresponding scale, along line III—III of FIG. 1.

The supporting substructure, to which strips 1 and 2 are secured, is illustrated in a purely schematical manner in FIG. 3 by way of a horizontal lath 4 to which the brackets 3 are fastened, e.g. as shown by means of spikes 5. The horizontal or transverse spacing or pitch of brackets 3 corresponds to the "module" dimension of the roof, i.e. the spacing between the median lines of two consecutive upper strips 2. The spacing of brackets 3 in the longitudinal direction of the strips may be approximately 1 m, dependent inter alia on the sheet thickness and on the desired spacing between laths 4. The module dimension mentioned above may be approximately 30 cm.

Each longitudinal edge zone 6 of a lower strip 1 has an S-shaped cross sectional profile including a first portion 7, which is curved inwardly towards the concave face of the strip, exactly or substantially along an arc of circle corresponding to an angle of slightly more than 180° at the centre. This first portion 7 is followed by a short, rectilinear profile portion 8 which merges into a curved portion 9 of opposite curvature, which portion 9 has an angle of 180° at the centre and a radius of curvature corresponding to the thickness of bracket 3. After portion 9 follows a short, rectilinear profile portion 8' extending substantially parallel to the rectilinear portion 8, and the profile terminates in a curvilinear portion 10 extending by and large parallel to a short section of the curved portion 7.

Each edge zone 11 of the convex upper strip 2 is formed as an arc of a circle with an inner radius of curvature corresponding to the outer radius of curvature of the median portion 9 of edge zone 6 and with an angle of essentially 180° at the centre.

As shown, bracket 3, which is made of heavier sheet material than strips 1 and 2, is generally U-shaped with a web portion 12 which serves for fastening the bracket to lath 4, and two upwardly extending lateral flanges or limbs 13. The free upper edge zone 14 of each lateral flange 13 is bent or folded such that its profile is complementary to the profile of the longitudinal edge zones 6 of strips 1, and the edge zones are retracted inwardly towards the centre line of the bracket, the cross section of which is thus narrowed at its upwardly oriented mouth.

When the roof covering is to be installed, a suitable number of brackets 3 are first fastened to laths 4, as described above. Then the concave lower strips 1 are mounted, whereby one edge zone 6 of each strip is first inserted into the opposed outer depression or cavity in the edge zones 14 of the associated brackets 3. Strip 1, which in its unloaded or fully relaxed stated is somewhat wider than corresponding to the distance between two rows of brackets 3, is then compressed laterally until its opposed edge zone 6 can be pushed into the other row of aligned brackets 3. Due to this dimensioning of the width of strip 1, the strip is held resiliently between the two rows of brackets 3 after it has been inserted.

After the insertion of the lower strips 1 the convex upper strips 2 are mounted. The maximum width of these strips is somewhat smaller in the unloaded state than when they have been mounted. Consequently, when each strip 2 has been resiliently expanded, pushed downwards over the two associated lower strips 1, and finally has sprung back, it clamps the lower strips resiliently and, thus, holds the lower strips securely engaged with brackets 3.

The resiliency of especially the concave lower strips 1 permits, given the dimensions of said strips, some variation in the spacing of successive rows of brackets 3, and in practice the difference between the maximum and minimum values of that spacing can be-about 3 to 4%. The resiliency of the strips also permits the execution of a watertight roof covering even on a rather irregular substructure, and the covering can accommodate rather large subsidence or other displacement of the substructure occurring later. If desired, the covering can also be slightly fan-shaped in plan view, e.g. on buildings with non-parallel end walls, since the successive rows of brackets 3, instead of being parallel as in the "normal" case, can include a small angle between them.

Figure 4:
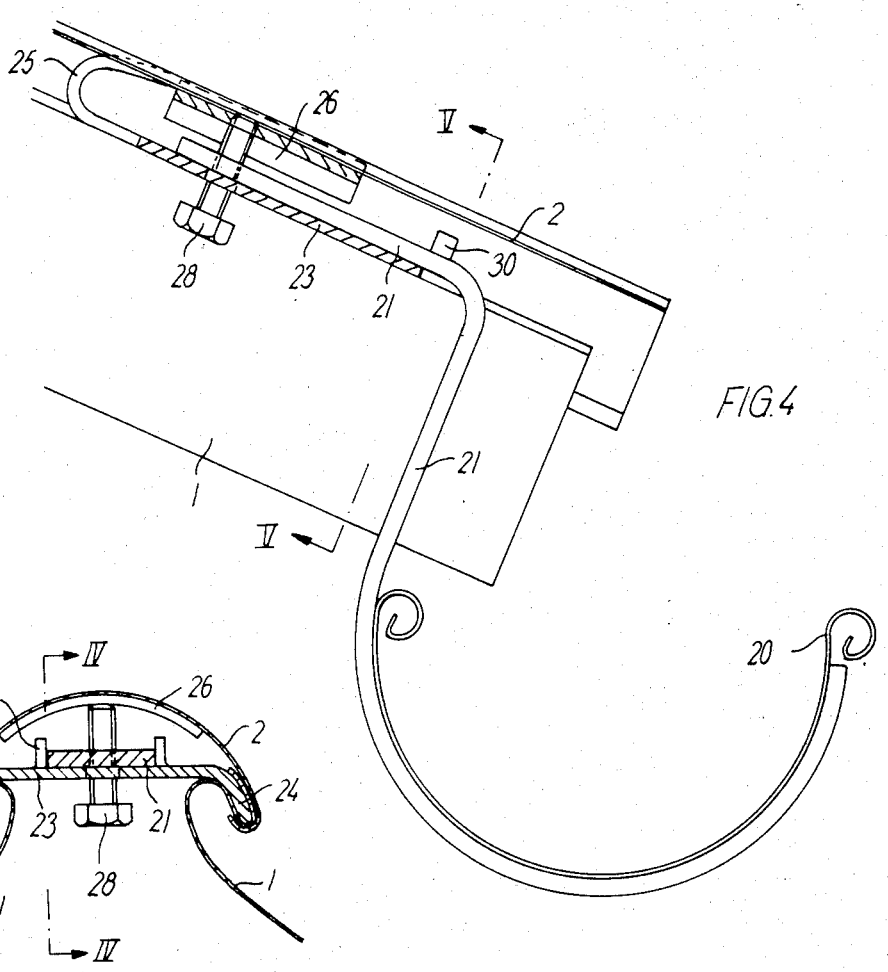
FIG. 4 is a section along line IV—IV of FIG. 1 or FIG. 5 and on the same scale as FIG. 3.
Figure 5:
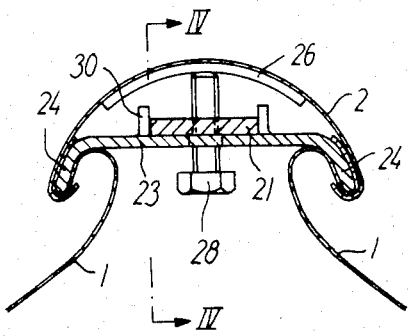
FIG. 5 is a section along line V—V of FIG. 4.
Figure 6:
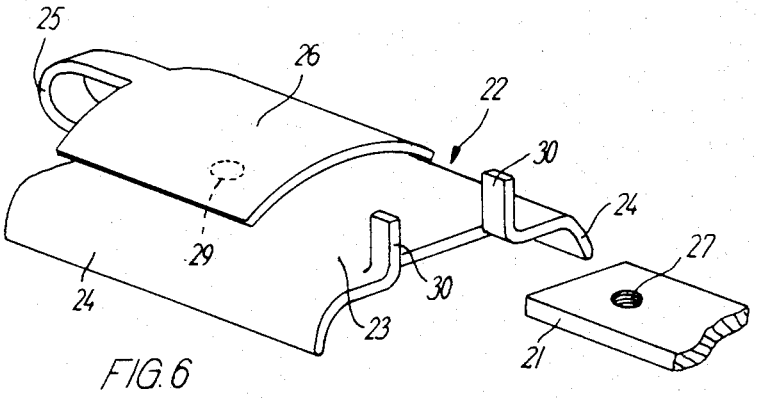
FIG. 6 is an exploded perspective view of a mounting member for a gutter bracket and part of the gutter bracket.

FIGS. 4–6 illustrate how the configuration, as described above, of the components of the roofing proper can be utilized for simplifying the installation of a gutter 20 below the lower edge of the roof, see also FIG. 1. The gutter is placed in properly spaced gutter brackets 21, which are secured in the spaces existing between a convex upper strip 2 and the adjoining concave lower strips 1 below the lowermost bracket 3 in each associated row of fastening brackets. For securing a gutter bracket there is employed a mounting member, shown in its entirety in FIG. 6, which comprises a bracket 22 with a flat median portion 23 and two edge zones 24 having the same cross sectional profile as the outermost part of the edge zones 14 of brackets 3. Through a strap 25 bent in the shape of a hairpin bracket 22 is integral with a superjacent clamp 26, the upper surface of which is convex and curved complementary to the underside of upper strip 2. At the inner end of gutter bracket 21 a threaded hole 27 extends through the bracket for receiving a clamping bolt 28, which is inserted from below through a clearance hole 29 in the median portion 23 of bracket 22. It will be seen from FIGS. 4 and 5 that when bolt 28 is screwed home, it will engage the underside of clamp 26 and press the clamp upwardly into engagement with the underside of strip 2 while at the same time gutter bracket 21 is clamped against the median portion 23 of bracket 22, the edge zones 24 of which are pressed downwardly into the upwardly open cavities in the edge zones of the lower strips 1. For guiding gutter bracket 21 laterally two tabs 30 may extend upwardly from the median portion 23 of bracket 22, as shown in FIG. 6. After the gutter bracket has been inserted the ends of these tabs can be bent downwardly to overlie the gutter bracket thus preventing it from being lifted.

It will readily be seen that the described means for securing gutter brackets 21 permits an exact alignment of all the gutter brackets—before they are finally fastened—to be carried out after the roof covering has been installed, thus ensuring the correct location of gutter 20 relative to the lower edge of the roof.

I claim:

1. A roof or wall covering comprising alternate first and second cover strips made of sheet material and formed with respective, resiliently interengaging longitudinal edge zones;

and fastening members for securing the covering to a supporting substructure;

wherein each said first cover strip has an outwardly concave central part merging into two longitudinal edge zones, the cross sectional profile of which is S-shaped and comprises an inner portion adjoining the central part of the strip and curved towards the concave face of said central part, said inner portion having a first radius of curvature, a median portion curved in the opposite direction and having a second, smaller radius of curvature, and an outer portion having a third radius of curvature larger than the first radius of curvature;

each said fastening member being formed as a U-shaped bracket having a web portion for securing to the substructure and two lateral flanges, the free edge zones of which are profiled complementary to the edge zones of the first cover strips and are curved inwardly towards the center line of the U at the transition of the adjoining portion of the respective lateral flange;

and each said second cover strip having an outwardly convex central part substantially narrower than the central part of the first cover strips and merging into two longitudinal edge zones the cross sectional profile of which is complementary to the median and outer portions of the edge zones of the first cover strips so that said outer portion of the edge zone of the first cover strip fits into a lateral flange of a fastening member and an edge zone of a second cover strip fits thereover to hold the assembly thereof together.

2. A roof or wall covering as claimed in claim 1, wherein the longitudinal edge profile of each first cover strip comprises two parallel and substantially rectilinear transition portions connecting the inner portion of the profile with the median portion thereof and the median portion of the profile with the outer, curved portion respectively.

3. A roof or wall covering as claimed in claim 1, in which there is a clearance between the free edge of each edge zone of a fastening member and the opposed median portion of the edge zone of a first cover strip.

4. Means for mounting a gutter bracket associated with a roof covering as claimed in claim 1, comprising a bracket of sheet material having two edge zones the profile of which is the same as that of the outer part of the edge zones of the fastening members, and a median part with a transverse hole therethrough;

a clamp resiliently connected to said median part and having an upwardly oriented curvature corresponding to the curvature of the central part of a second cover strip;

and a clamping bolt insertable through said transverse hole for urging the clamp and the bracket apart.

5. Mounting means as claimed in claim 4, wherein the bracket of sheet material is integral with the clamp and connected thereto by means of a narrow, hairpin bent strap.

* * * * *